US010267156B2

(12) United States Patent
Davidson et al.

(10) Patent No.: US 10,267,156 B2
(45) Date of Patent: Apr. 23, 2019

(54) TURBINE BUCKET ASSEMBLY AND TURBINE SYSTEM

(71) Applicant: GENERAL ELECTRIC COMPANY, Schenectady, NY (US)

(72) Inventors: Dwight Eric Davidson, Greer, SC (US); Michael David McDufford, Greenville, SC (US); Brian Denver Potter, Greer, SC (US); Stephen Joseph Balsone, Simpsonville, SC (US); Stephen Paul Wassynger, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1087 days.

(21) Appl. No.: 14/290,076

(22) Filed: May 29, 2014

(65) Prior Publication Data

US 2015/0345296 A1 Dec. 3, 2015

(51) Int. Cl.
*F01D 5/14* (2006.01)
*F01D 5/16* (2006.01)
(Continued)

(52) U.S. Cl.
CPC ..... *F01D 5/14* (2013.01); *F01D 5/16* (2013.01); *F01D 5/225* (2013.01); *F01D 5/28* (2013.01);
(Continued)

(58) Field of Classification Search
CPC ... F01D 5/14; F01D 5/16; F01D 5/225; F01D 5/28; F01D 5/286; F01D 5/30;
(Continued)

(56) References Cited

U.S. PATENT DOCUMENTS 3,999,031 A 12/1976 Yonezawa et al.
4,120,607 A 10/1978 Coplin
(Continued)

OTHER PUBLICATIONS

Accuratus Ceramic Corp., "Silicon Carbide Material Properties" available at http://accuratus.com/pdf/sicprops.pdf.*
(Continued)

*Primary Examiner* — Dwayne J White
(74) *Attorney, Agent, or Firm* — McNees Wallace & Nurick LLC

(57) ABSTRACT

A turbine bucket assembly and turbine system are disclosed. The turbine bucket assembly includes a single-lobe joint having an integral platform, the joint having a first axial length; a segmented airfoil having a root segment extending radially outward from the platform and a tip segment coupled to the root segment, the tip segment having a second axial length, which is less than the first axial length; and a turbine wheel defining a receptacle with a geometry corresponding to the single-lobe joint and being coupled to the single-lobe joint. The tip segment includes a tip segment material, the root segment includes a root segment material, and the turbine wheel includes a turbine wheel material, the root segment material and the turbine wheel material having a lower heat resistance and a higher thermal expansion than the tip segment material.

1 Claim, 4 Drawing Sheets

(51) Int. Cl.
*F01D 5/22* (2006.01)
*F01D 5/28* (2006.01)
*F01D 5/30* (2006.01)

(52) U.S. Cl.
CPC ..... *F01D 5/3007* (2013.01); *F05D 2230/642* (2013.01)

(58) Field of Classification Search
CPC ..... F01D 5/3007; F01D 5/3023; F01D 2230/642; F03B 1/02; F03B 3/121; F03B 3/128
See application file for complete search history.

(56) References Cited

U.S. PATENT DOCUMENTS 4,161,125 A 7/1979 Degnan
4,252,860 A 2/1981 Brennan et al.
4,300,439 A 11/1981 Degnan et al.
4,449,446 A 5/1984 Degnan et al.
4,911,990 A 3/1990 Prewo et al.
4,999,256 A 3/1991 Prewo et al.
5,609,698 A 3/1997 Kelly et al.
5,823,243 A 10/1998 Kelly
6,048,174 A 4/2000 Samit et al.
6,206,634 B1 3/2001 Doi et al.
6,254,341 B1 7/2001 Ackerman et al.
6,283,715 B1 9/2001 Nagaraj et al.
6,329,633 B1 12/2001 Lamm et al.
6,398,504 B1 6/2002 Arai et al.
6,493,936 B2 12/2002 Doi et al.
6,575,700 B2 6/2003 Araj et al.
6,582,194 B1 6/2003 Birkner et al.
6,642,159 B1 11/2003 Bhatnagar et al.
6,758,653 B2 7/2004 Morrison
6,854,959 B2 2/2005 Barb
6,905,559 B2 6/2005 O'Hara et al.
6,908,518 B2 6/2005 Bouse et al.
6,993,811 B2 2/2006 Das et al.
7,104,760 B2 9/2006 Burdgick
7,186,092 B2 3/2007 Bruce et al.
7,195,455 B2 3/2007 Stonitsch et al.
7,278,829 B2 10/2007 Roedl et al.
7,300,708 B2 11/2007 Gigliotti, Jr. et al.
7,575,418 B2 8/2009 Gigliotti et al.
7,581,933 B2 9/2009 Bruce et al.
7,762,783 B2 * 7/2010 Cairo ..... B23P 6/005 416/223 R
7,789,630 B2 9/2010 Schilling et al.
7,794,197 B2 9/2010 Thompson et al.
7,828,526 B2 11/2010 Cairo et al.
7,942,641 B2 5/2011 Bailey et al.
8,118,561 B2 2/2012 Bruce et al.
8,182,228 B2 5/2012 Riley et al.
8,240,046 B2 8/2012 Peretti et al.
8,282,357 B2 10/2012 Beckford
8,398,374 B2 * 3/2013 Roberts ..... F01D 5/147 416/193 R
8,597,440 B2 12/2013 Lupulescu et al.
8,668,456 B2 3/2014 Merriman et al.
2011/0217178 A1 * 9/2011 Mazzola ..... F01D 5/14 416/241 R
2011/0305578 A1 * 12/2011 Smarsly ..... B23K 20/1205 416/223 R
2012/0051930 A1 * 3/2012 Pandey ..... F01D 5/143 416/223 A
2016/0215627 A1 * 7/2016 Roberge ..... F01D 5/147
2016/0222802 A1 * 8/2016 Holowczak ..... F01D 5/14

OTHER PUBLICATIONS

Agilent Tech., 17 Laser and Optics User's Manual 1-12, Linear Thermal Expansion Coefficients of Metals and Alloys (2002), available at http://psec.uchicago.edu/thermal_coefficients/cte_metals_05517-90143.pdf.*
Kutz, Myer. Handbook of Materials Selection, Wiley, 2002, p. 314, excerpt available at http://books.google.com/books?isbn=0471359246.*
Total Materia, "Titanium Aluminide Alloys: Part One" available at http://www.totalmateria.com/page.aspx?ID=CheckArticle&site=ktn&NM=269.*
Cobalt Facts, "Cobalt Metallurgical Uses" (2006), available at http://www.thecdi.com/cdi/images/documents/facts/COBALT_FACTS-Metallurgical_%20uses.pdf.*
LucasMilhaupt, "Coefficients of Thermal Expansion Chart" available at http://www.lucasmilhaupt.com/en-US/brazingfundamentals/coefficientsofthermalexpansionchart/.*
Fager, Sanna and Karlsson, Joakim. "Gamma Titanium Manufactured by Electron Beam Melting" Chalmers University of Tech., p. 4 (2010), available at http://publications.lib.chalmers.se/records/fulltext/127716.pdf.*
"Thermal Resistance & Thermal Conductance-C-Therm-Thermal Conductivity Instruments", Jul. 28, 2017, http://ctherm.com/products/tci_thermal_conductivity/helpful_links_tools/thermal_resistance_thermal_conductance/.

* cited by examiner

TURBINE BUCKET ASSEMBLY AND TURBINE SYSTEM

FIELD OF THE INVENTION

The present invention is directed to turbine components and turbine systems. More particularly, the present invention is directed to turbine bucket assemblies and turbine systems having one or more turbine bucket assemblies.

BACKGROUND OF THE INVENTION

At least some known gas turbine engines include a combustor, a compressor, and/or turbines that include a rotor disk that includes a plurality of rotor blades, or buckets, that extend radially outward therefrom. The plurality of rotating turbine blades or buckets channel high-temperature fluids, such as combustion gases or steam, through either a gas turbine engine or a steam turbine engine. The roots of at least some known buckets are coupled to the disk with dovetails that are inserted within corresponding dovetail slots formed in the rotor disk to form a bladed disk, or "blisk." Because such turbine engines operate at relatively high temperatures and may be relatively large, the operating capacity of such an engine may be at least partially limited by the materials used in fabricating the buckets and/or the length of the airfoil portions of the buckets. To facilitate enhanced performance, at least some engine manufacturers have increased the size of the engines, thus resulting in an increase in the length of the airfoil portion of the buckets. Such an increase can require the size of the dovetails and the dovetail slots to be increased to ensure the longer buckets are retained in position.

With or without repairable and/or replaceable airfoil tip portions, turbine bucket assemblies are subjected to a variety of forces. Such forces require different portions of the turbine bucket assemblies to have different properties. It is known that variation of density can provide benefit, depending upon the position of the material. However, further characterization of properties providing beneficial results, especially relating to specific materials, would provide additional benefits.

A turbine bucket assembly and turbine system having a turbine bucket assembly with improvements would be desirable in the art.

BRIEF DESCRIPTION OF THE INVENTION

In an embodiment, a turbine bucket assembly includes a single-lobe joint having an integral platform, the joint having a first axial length; a segmented airfoil having a root segment extending radially outward from the integral platform and a tip segment coupled to the root segment, the tip segment having a second axial length, the second axial length being less than the first axial length; and a turbine wheel defining a receptacle with a geometry corresponding to the single-lobe joint and being coupled to the single-lobe joint. The tip segment includes a tip segment material, the root segment includes a root segment material, and the turbine wheel includes a turbine wheel material, the root segment material and the turbine wheel material having lower heat resistance and higher thermal expansion than the tip segment material.

In another embodiment, a turbine bucket assembly includes a single-lobe joint having a platform, the joint having a first axial length; a segmented airfoil having a root segment extending radially outward from the integral platform and a tip segment coupled to the root segment, the tip segment having a second axial length, the second axial length being less than the first axial length; and a turbine wheel defining a receptacle with a geometry corresponding to the single-lobe joint and being removably coupled to the single-lobe joint. The tip segment includes a ceramic matrix composite, the root segment includes a titanium aluminide, and the turbine wheel includes a superalloy.

In another embodiment, a gas turbine system includes a compressor section, a combustor section configured to receive air from the compressor section, and a turbine section in fluid communication with the combustor section, the turbine section comprising a stator and a turbine bucket assembly. The turbine bucket assembly includes a single-lobe joint having an integral platform, the joint having a first axial length; a segmented airfoil having a root segment extending radially outward from the integral platform and a tip segment coupled to the root segment, the tip segment having a second axial length, the second axial length being less than the first axial length; and a turbine wheel defining a receptacle with a geometry corresponding to the single-lobe joint and being coupled to the single-lobe joint. The tip segment includes a tip segment material, the root segment includes a root segment material, and the turbine wheel includes a turbine wheel material, the root segment material and the turbine wheel material having lower heat resistance and higher thermal expansion than the tip segment material.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a turbine bucket assembly and a turbine system. In addition, methods of assembling and/or producing such turbine bucket assemblies and turbine systems are apparent from the disclosure. Embodiments of the present disclosure, for example, in comparison to similar concepts failing to include one or more of the features disclosed herein, use a lighter material in a tip segment of an airfoil in comparison to a root segment to reduce structural loading and/or permit control of a vibratory response (in comparison to a monolithic airfoil), use a denser material in a root segment of an airfoil to reduce risk of failure (in comparison to a monolithic airfoil), permit easier repair of damage (for example, by a tip-rub event, overheating, and/or any other damaging event) by permitting the tip segment to be repaired alone without requiring more expensive and more time-consuming removal and repair/replacement of the complete turbine bucket, reduce overall operating and maintenance costs, reduce duration of out-of-service periods for repairs, permit other suitable advantages, permit larger or smaller sized engines and/or turbine buckets to be used, permit portions of a turbine bucket assembly to be exposed to higher temperatures, permit properties in a specific portion of a turbine bucket assembly to be resistant to additional forces, permit use of additional materials for portions of turbine bucket assemblies, or a combination thereof.

Figure 1:
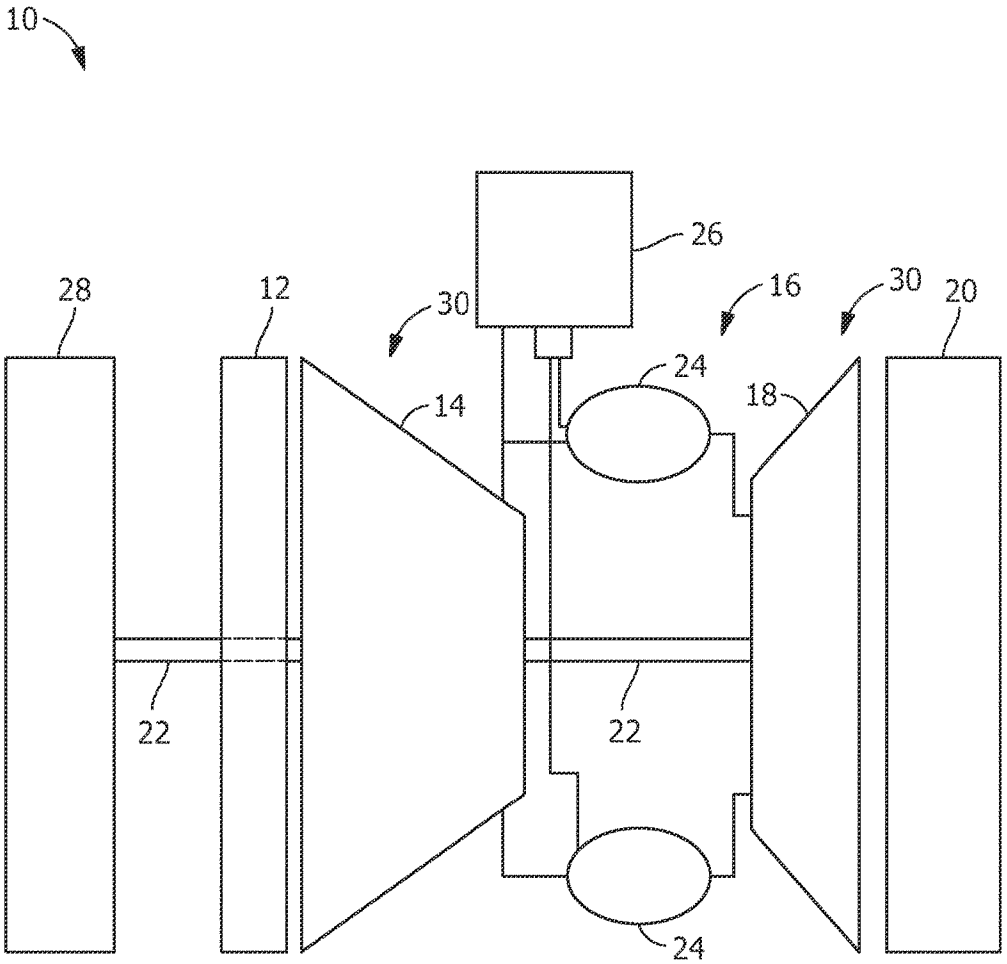
FIG. 1 is a schematic view of a turbine system having a turbine bucket assembly, according to an embodiment of the disclosure.
Figure 3:
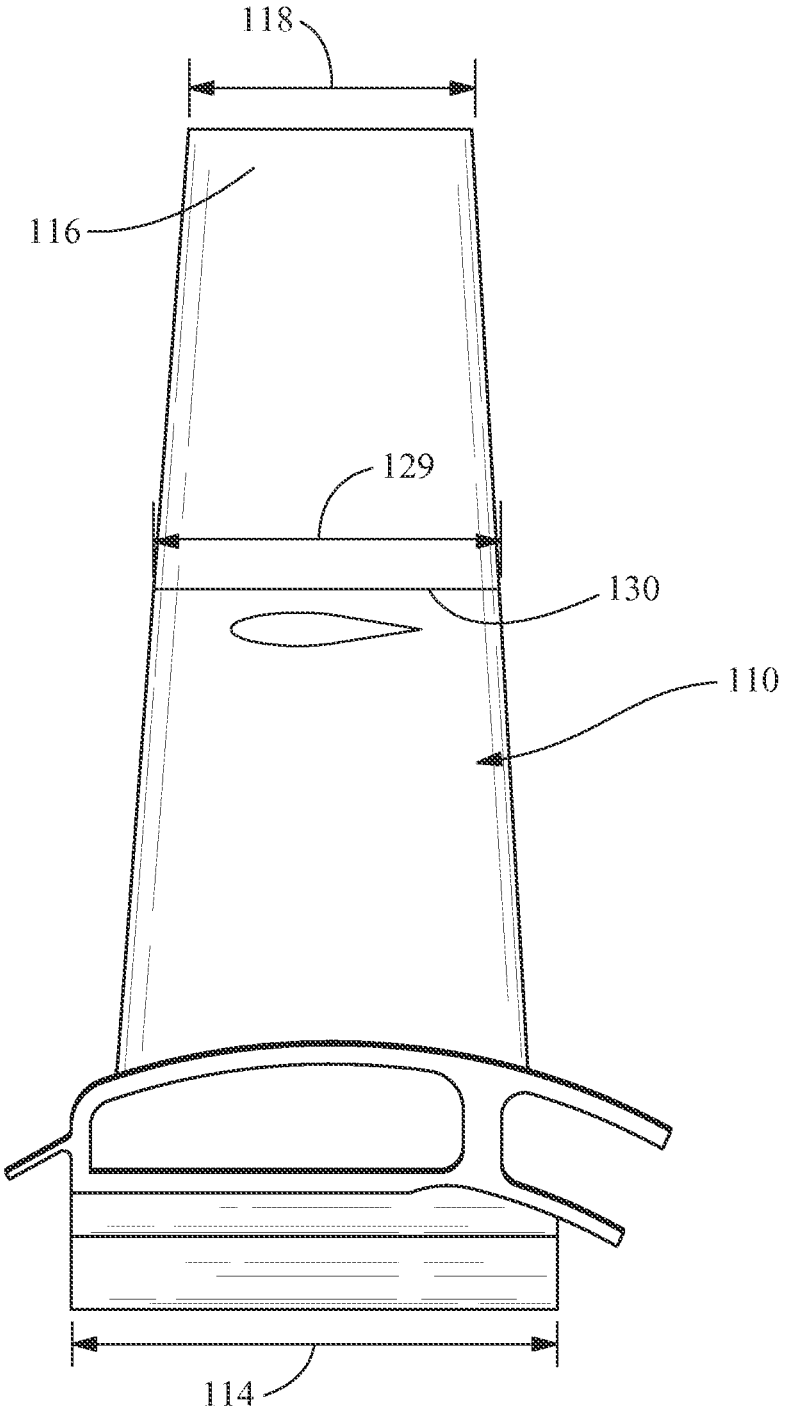
FIG. 3 is a right-side plan view of a latter stage turbine bucket (for example, a bucket for use in a third or fourth stage, of a four-stage turbine), according to an embodiment of the disclosure.

FIG. 1 is a schematic view of a turbine system 10, such as, a gas turbine engine system, a power generation system, any other suitable system utilizing blades/buckets, or a combination thereof. As used herein, the term "blade" is used interchangeably with the term "bucket." A suitable turbine bucket is shown in FIG. 3, which illustrates a bucket for use in a latter stage of the turbine (for example, a third or fourth stage of a four-stage turbine). In one embodiment, the system 10 includes an intake section 12, a compressor section 14 downstream from the intake section 12, a combustor section 16 coupled downstream from the intake section 12, a turbine section 18 coupled downstream from the combustor section 16, and an exhaust section 20. The turbine section 18 is drivingly coupled to the compressor section 14 via a rotor shaft 22. The combustor section 16 includes a plurality of combustors 24 and is coupled to the compressor section 14 such that each of the combustors 24 is in fluid communication with the compressor section 14. A fuel nozzle assembly 26 is coupled to each of the combustors 24. The turbine section 18 is rotatably coupled to the compressor section 14 and to a load 28, such as, but not limited to, an electrical generator and/or a mechanical drive application. The compressor section 14 and/or the turbine section 18 include at least one blade or turbine bucket 30 coupled to the rotor shaft 22.

During operation, the intake section 12 channels air towards the compressor section 14. The compressor section 14 compresses the inlet air to higher pressures and temperatures and discharges the compressed air towards the combustor section 16. The compressed air is mixed with fuel and ignited to generate combustion gases that flow to the turbine section 18, which drives the compressor section 14 and/or the load 28. Specifically, at least a portion of the compressed air is supplied to fuel nozzle assembly 26. Fuel is channeled to the fuel nozzle assembly 26. The fuel is mixed with the air and ignited downstream of fuel nozzle assembly 26 in the combustor section 16. Combustion gases are generated and channeled to the turbine section 18. Gas stream thermal energy is converted to mechanical rotational energy in the turbine section 18. Exhaust gases exit the turbine section 18 and flow through the exhaust section 20 to the ambient atmosphere.

Figure 2:
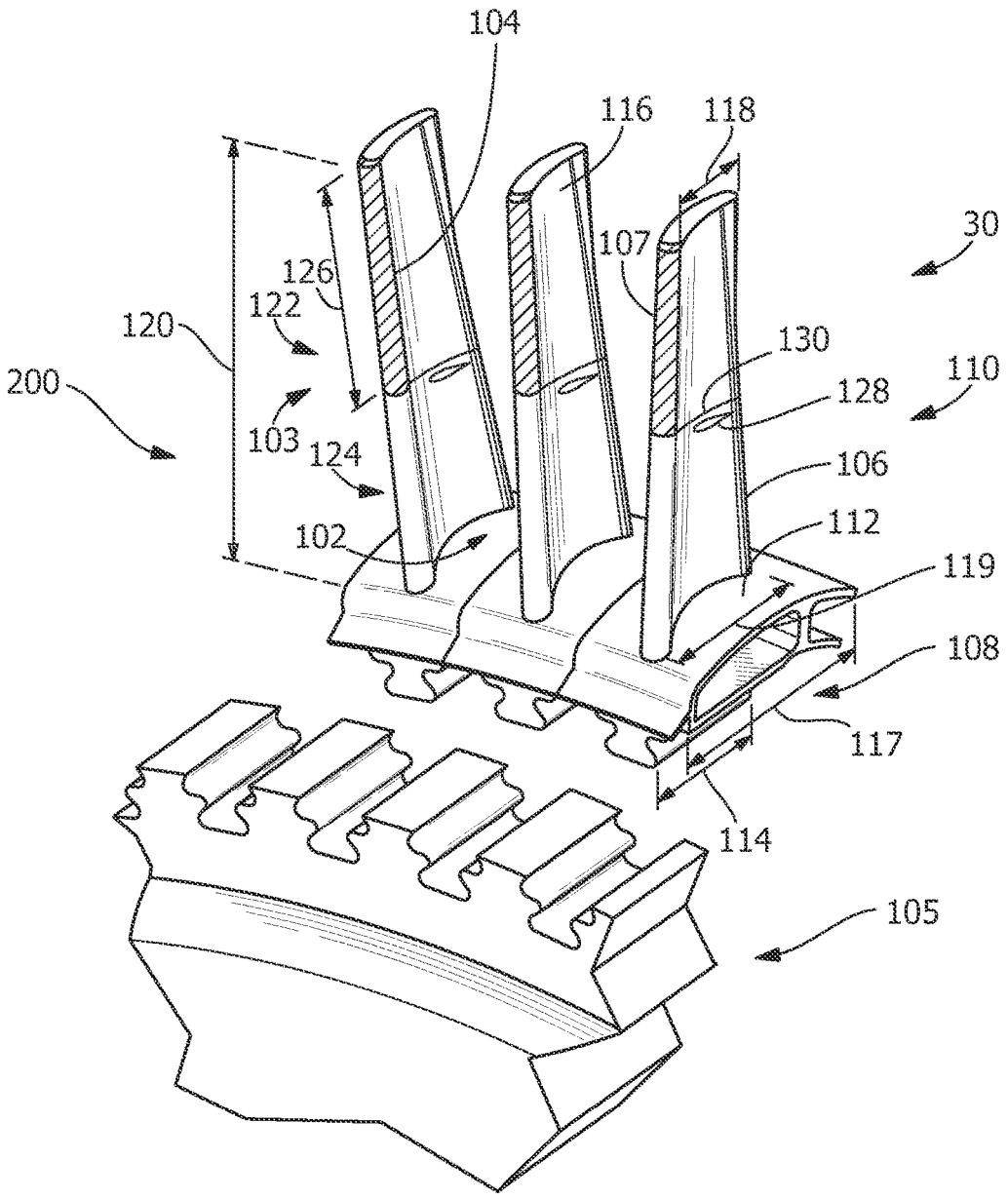
FIG. 2 is a perspective view of a turbine bucket assembly having a segmented airfoil in a turbine bucket, according to an embodiment of the disclosure.

FIG. 2 is a perspective view of a turbine bucket assembly 200 having the turbine bucket 30 capable of use with the system 10. The turbine bucket 30 has an airfoil 110. The airfoil 110 is segmented (for example, having a tip segment 122 and a root segment 124, which are formed separately or are separable at a segment joint 130). The turbine bucket 30 includes a pressure side 102 and a suction side 103 connected together at a leading edge 104 and a trailing edge 106. The pressure side 102 includes a generally concave geometry and the suction side 103 includes a generally convex geometry. The turbine bucket 30 includes a joint 108, and/or any other suitable features, such as a platform 112 extending between the joint 108 and the airfoil 110.

The joint 108 is a dovetail, is multi-lobed, is single-lobed, is a portion of a blisk, is integral with the airfoil 110 (for example, such that there are no seams or inconsistencies in the turbine bucket 30 where the platform 112 transitions to the airfoil 110), is another suitable mechanism or device for securing the turbine bucket 30, or is a combination thereof. The coefficients of thermal expansion of the materials in the components (for example, a wheel 105, the root segment 124, and the tip segment 122) dictate the joint type between the respective components. For instance, when the materials have a nearly identical or identical coefficient of thermal expansion over a wide range of temperatures, the joint 108 between the components is capable of being either a single-lobe or a multi-lobe joint. A multi-lobe joint may be preferred in some circumstances. In contrast, when the materials have dissimilar coefficients of thermal expansion, a single-lobe joint between the components may be preferred.

In one embodiment, the turbine bucket 30 couples to the wheel 105 via the joint 108 and extends radially outward from the wheel 105. The joint 108 has a single-lobe geometry corresponding to a respective receptacle in the wheel 105 and is capable of being removably or permanently coupled to the wheel 105 by any suitable technique. One suitable technique includes the joint 108 being removably coupled to the wheel 105 by an axial joint or a circumferential joint. Another suitable technique includes the joint 108 being removably coupled to the wheel 105 by a dovetail joint, a dado joint, a box joint, a tongue-and-groove joint, or a combination thereof.

In one embodiment, the wheel 105 is a turbine wheel having a plurality of receptacles with geometry corresponding to the single-lobe joints 108 of a corresponding plurality of turbine buckets 30, and the geometry of the wheel 105 defines a rim of the turbine wheel. In an alternate embodiment (FIG. 1), the turbine buckets 30 couple, via the joints 108, directly to the rotor shaft 22 and extend radially outward from the rotor shaft 22.

In one embodiment, the joint 108 has an axial joint length 114 that facilitates securing. In one embodiment, the platform 112 extends radially outward from the joint 108 and has a platform length 117 that is equal to or approximately equal to the axial joint length 114 (as shown in FIGS. 2 and 3).

In one embodiment, the airfoil 110 extends radially outward from the joint 108, extends radially outward from an outer platform surface of the platform 112, has an initial airfoil length 119 that is approximately equal to the axial joint length 114, and/or decreases in axial length to a tip end length 118 at a tip end 116 of the turbine bucket 30, such that the tip end length 118 is shorter than the axial joint length 114 when viewed from the right-side profile, as shown in FIG. 3. The tip end length 118 and a tip width are capable of being varied, depending on the application of turbine bucket 30 and/or the system 10. The airfoil 110 has a first or radial airfoil length 120 measured from platform 112 to tip end 116, for example, to permit increased performance of the turbine bucket 30. The radial airfoil length 120 is capable of being varied, depending on the application of the turbine bucket 30 or the system 10. In one embodiment, the airfoil 110 has an airfoil width sized to facilitate locking to the wheel 105.

The airfoil 110 is a segmented portion of the turbine bucket 30. In one embodiment, as shown in FIG. 2, the airfoil 110 includes a first or the tip segment 122 coupled (removably or permanently) to a second or the root segment 124. The root segment 124 is proximal to the wheel 105 or the rotor shaft 22 (see FIG. 1). The tip segment 122 is distal from the wheel 105 or the rotor shaft 22 (see FIG. 1). In one embodiment, the tip segment 122 is coupled to the root segment 124 at the segment joint 130, which is a single-lobe segment joint, for example, an axial segment joint, a circumferential segment joint, a curved dovetail segment joint, a dado segment joint, a box segment joint, a tongue-and-groove segment joint, or a combination thereof. As used herein, the term "axial segment joint" is used to describe a segment joint that is formed along an axial length of a cross-section of the airfoil 110. As used herein, the term "circumferential joint" is used to describe a segment joint that is formed along the circumferential width of the airfoil 110.

The tip segment 122 includes a tip segment length 126 that is comparable to the radial airfoil length 120, for example, by having a relative ratio to the radial airfoil length 120, such as, about 25 percent, about 40 percent, greater than 40 percent, less than about 50 percent, about 50 percent, greater than about 50 percent, about 60 percent, between about 40 percent and about 60 percent, about 75 percent, between about 25 percent and about 75 percent, between about 40 percent and about 75 percent, or any suitable combination, sub-combination, range, or sub-range therein. The tip segment length 126 extends to a mid-region of the airfoil 110 having an axial length 129, which is greater than the tip end length 118 and less than the initial airfoil length 119, when viewed from the right-side profile as shown in FIG. 3.

Figure 4:
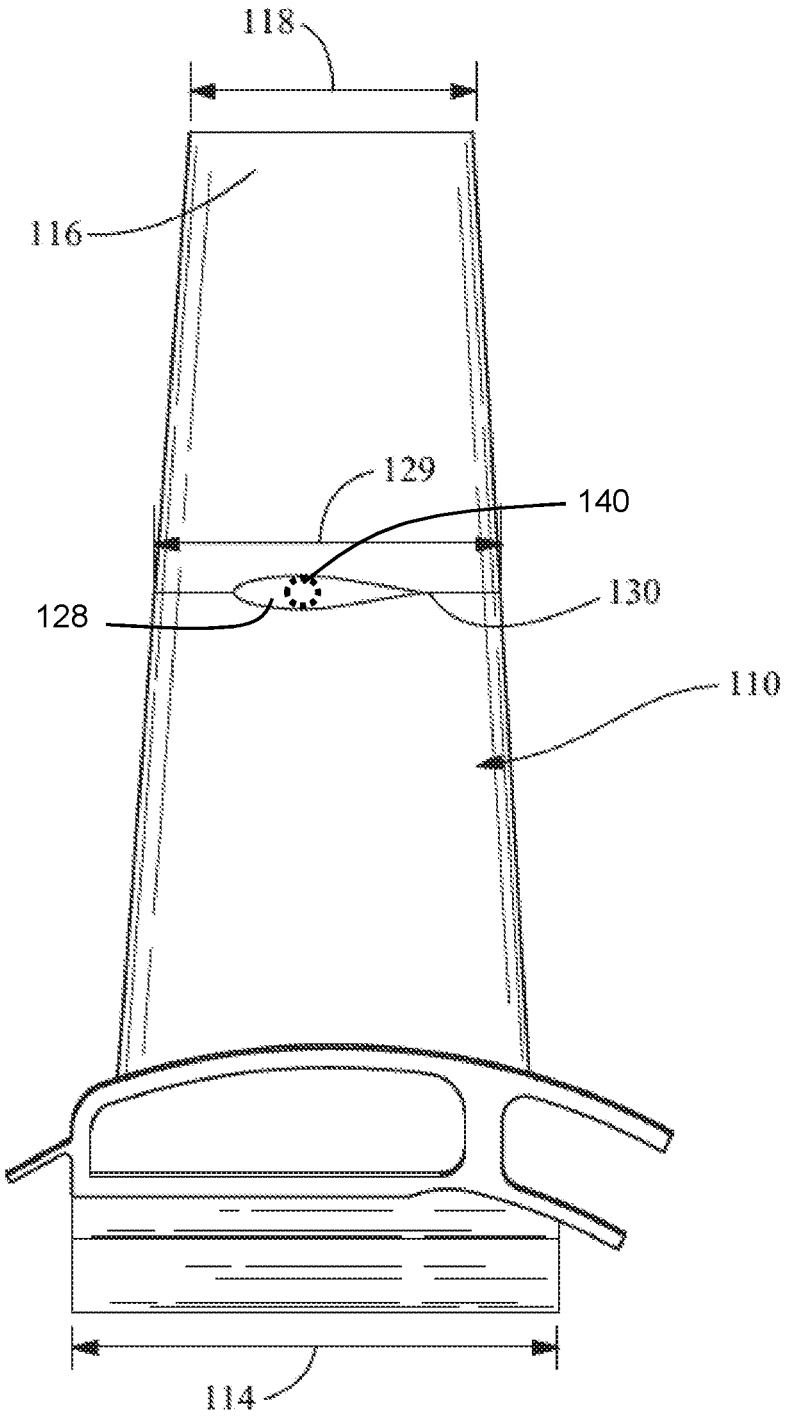
FIG. 4 is a right side plan view of a latter stage turbine bucket, according to another embodiment of the disclosure.

In one embodiment, the airfoil 110 includes at least one mid-shroud damper 128 coupled to the root segment 124, for example, to dampen vibrations in the airfoil 110 and/or to provide structural support to the airfoil 110 during operation of the system 10. In one embodiment, the mid-shroud damper 128 works cooperatively with damping pins 140 illustrated in FIG. 4 located between the root segment 124 and the tip segment 122, for example, to selectively prevent the tip segment 122 from uncoupling from the root segment 124 and to maintain a relative position of the root segment with respect to the tip segment. Additionally or alternatively, damping pins (not shown) may be used between the joint 108 and the receptacle in the wheel 105 to secure the bucket 30 to the wheel 105.

The tip segment 122, the root segment 124, the joint 108, and/or the wheel 105 include any suitable combination of materials capable of withstanding the operational demands of the system 10 and/or operating in conjunction with the features of the turbine bucket 30. The materials are similar materials, the same materials, or different materials, which are chosen to achieve a balance between considerations of weight and cost and performance at higher temperatures and/or speeds.

Suitable materials for the tip segment 122 include, but are not limited to, ceramic matrix composite materials, titanium aluminide, materials having a similar or lower thermal expansion than materials in the root segment 124 and/or the wheel 105, materials having similar or higher heat resistance than materials in the root segment 124 and/or the wheel 105 (for example, to accommodate the tip segment 122 being exposed to higher operating temperatures), materials having a similar or lower density than materials in the root segment 124 and/or the wheel 105 (for example, resulting in a lower rotating mass in the turbine bucket 30), or a combination thereof. In the exemplary embodiment described herein, the tip segment 122 includes a ceramic matrix composite material.

The joint 108, the platform 112, and the root segment 124 are formed integrally with one another and, as such, are manufactured from the same material. Suitable materials for the root segment 124 include, but are not limited to, superalloys, titanium aluminide, materials having a similar or higher thermal expansion than materials in the tip segment 122, materials having similar or lower heat resistance than materials in the tip segment 122, materials having a similar or lower thermal expansion than materials in the wheel 105, materials having a similar or higher heat resistance than materials in the wheel 105 (for example, to accommodate the tip segment 122 being exposed to higher operating temperatures), materials having a similar or lower density than materials in the wheel 105 (for example, resulting in a lower rotating mass in the turbine bucket 30), or a combination thereof. In the exemplary embodiment described herein, the root segment 124 includes a titanium aluminide.

Suitable materials for the wheel 105 include, but are not limited to, cobalt-based superalloys, nickel-based superalloys, steel-based alloys, materials having a similar or higher thermal expansion than materials in the root segment 124 and/or the tip segment 122, materials having similar or lower heat resistance than materials in the root segment 124 and/or the tip segment 122, materials having a similar or higher density than materials in the root segment 124 and/or the tip segment 122, or a combination thereof. In the exemplary embodiment described herein, the wheel 105 includes a superalloy having the properties discussed above.

As used herein, the term "ceramic matrix composite" includes, but is not limited to, carbon-fiber-reinforced carbon (C/C), carbon-fiber-reinforced silicon carbide (C/SiC), and silicon-carbide-fiber-reinforced silicon carbide (SiC/SiC). In one embodiment, the ceramic matrix composite material has increased elongation, fracture toughness, thermal shock, dynamical load capability, and anisotropic properties as compared to a (non-reinforced) monolithic ceramic structure.

As used herein, the term "titanium aluminide" includes, but is not limited to, typical compositions, by weight, of about 45% Ti and about 50% Al (TiAl) and/or a molar ratio of about 1 mole Ti to about 1 mole Al, $TiAl_2$ (for example, at a molar ratio of about 1 mole Ti to about 2 moles Al), $TiAl_3$ (for example, at a molar ratio of about 1 mole Ti to about 3 moles Al), $Ti_3Al$ (for example, at a molar ratio of about 3 moles Ti to about 1 mole Al), or other suitable mixtures thereof.

As used herein, the term "superalloy" includes, but is not limited to, nickel-based alloys, cobalt-based alloys, or steel-based alloys. One typical nickel-based superalloy material, which is sold under the tradename INCONEL® 718 by Special Metal Corporation of New Hartford, N.Y., has a composition, by weight, of about 50.0-55.0% Ni, about 17.0-21.0% Cr, about 4.75-5% Nb, about 2.8-3.3% Mo, about 1.0% Co, about 0.65-1.15% Al, about 0.35% Mn, about 0.35% Si, about 0.2-0.8% Cu, about 0.3% Ti, about 0.08% C, about 0.015% S, about 0.015% P, and about 0.006% B, and a balance of Fe. An exemplary CrMoV (steel-based) superalloy composition has a composition, by weight %, of about 0.90-1.50% Mo, about 0.90-1.25% Cr, about 0.55-0.90% Mn, about 0.35-0.55% Ni, about 0.25-0.33% C, 0.20-0.30% V, no more than about 0.35% Si, no more than about 0.35% Cu, no more than 0.012% P, no more than about 0.012% S, and the balance Fe and trace impurities.

Referring again to FIG. 2, in one embodiment, the turbine bucket 30 includes impact strips 107 on the airfoil 110, which increase impact toughness of the component to which they are attached. The impact strips 107 are capable of being produced from a similar or different material from at least a portion of the airfoil 110 and/or are capable of possessing similar or different properties from at least a portion of the airfoil 110. The impact strips 107 are positioned on the leading edge 104 of the turbine bucket 30 (as shown), the trailing edge 106 of the turbine bucket 30, on the tip segment 122, the root segment 124, or a combination thereof. In one embodiment, the impact strips 107 on the leading edge 104 of the tip segments 122 are on any and/or all turbine stages, whereas the impact strips 107 on the trailing edge 106 of the tip segments 122 are on any and/or all turbine stages except the last stage.

The impact strips 107 are attached by one or more chemical and/or mechanical techniques, for example, based upon physics-based methods (such as geometry) and material science methods (such as alloying). In one embodiment, the impact strips 107 are chemically attached, for example, via in-situ material processing, such as cast-in, in-situ extrusion, in-situ forging, other suitable techniques, or a combination thereof. Additionally or alternatively, in one embodiment, the impact strips 107 are chemically attached via post-material initial processing, such as diffusion bonding, alloy brazing, welding, other suitable techniques, or a combination thereof. In another embodiment, the impact strips 107 are mechanically attached via glue, rivets, stem pins, buttons, or retention joints (for example, a dado joint, a box joint, and/or a tongue-and-groove joint), other suitable techniques, or a combination thereof.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A turbine bucket assembly comprising:

a single-lobe joint having a platform, the joint having a first axial length;

a segmented airfoil having a root segment extending radially outward from the platform and a tip segment coupled to the root segment, the tip segment having a second axial length, the second axial length being less than the first axial length; and a turbine wheel defining a receptacle with a geometry corresponding to the single-lobe joint and being removably coupled to the single-lobe joint;

wherein the tip segment includes a ceramic matrix composite, the root segment includes a titanium aluminide, and the turbine wheel includes a superalloy.

* * * * *